US007815452B2

(12) United States Patent
Lee et al.

(10) Patent No.: US 7,815,452 B2
(45) Date of Patent: Oct. 19, 2010

(54) ELECTRICAL CONNECTOR

(75) Inventors: Kuo-Chi Lee, Taipei County (TW); Chin-Huang Lin, Taipei County (TW)

(73) Assignee: Concraft Holding Co., Ltd., Grand Cayman (KY)

( * ) Notice: Subject to any disclaimer, the term of this patent is extended or adjusted under 35 U.S.C. 154(b) by 0 days.

(21) Appl. No.: 12/367,747

(22) Filed: Feb. 9, 2009

(65) Prior Publication Data

US 2010/0167571 A1 Jul. 1, 2010

(30) Foreign Application Priority Data

Dec. 26, 2008 (TW) ..... 97223333 U

(51) Int. Cl.
*H01R 13/62* (2006.01)

(52) U.S. Cl. ..... 439/326; 439/79; 439/540.1

(58) Field of Classification Search ..... 439/326, 439/79, 540.1
See application file for complete search history.

(56) References Cited

U.S. PATENT DOCUMENTS 7,338,307 B2 * 3/2008 Zhang et al. ..... 439/326
7,427,208 B2 * 9/2008 Yang et al. ..... 439/326
7,445,497 B2 * 11/2008 Zhang ..... 439/541.5
7,614,899 B2 * 11/2009 Zhu et al. ..... 439/325
2004/0092148 A1 * 5/2004 Yu ..... 439/326

* cited by examiner

*Primary Examiner*—Hien Vu
(74) *Attorney, Agent, or Firm*—Rosenberg, Klein & Lee

(57) ABSTRACT

An electrical connector includes an insulated body having an insert face formed with a plurality of terminal holes, a mounting face, a fixing member and a plurality of terminals. The insert face is dented inwardly so as to form a plug reception chamber in spatial communication with the terminal holes. A fixing element extends outwardly and downwardly from the insulated body. The fixing member is integrally formed with the mounting face of the insulated body via an injection molding process such that the fixing element of the insulated body is integrally formed with the fixing member. The terminals includes a row of terminals, each having an embed section embedded within the fixing member along an extension direction via an insert-molding process and a contact section projecting from one end of the front embed section through a respective one of the terminal holes and so as to be retained within the plug reception chamber in the insulated body.

6 Claims, 9 Drawing Sheets

ELECTRICAL CONNECTOR

This application claims the benefits of the Taiwan Patent Application Serial NO. 097223333, filed on Dec. 26, 2008, the subject matter of which is incorporated herein by reference.

BACKGROUND OF THE INVENTION

1. Field of the Invention

The present invention relates to an electrical connector, more particularly to an electrical connector including an insulated body embedded with a plurality of terminals via an insert-molding process and a fixing member integrally formed with the insulated body.

2. Description of the Prior Art

Most of PCs (personal computer), TV sets and electronic devices have an outer casing provided with built-in electrical connector 100*a* for electrical connection with a peripheral device (such as DVD player) to facilitate signal transmission therebetween.

FIG. 1 shows a partly exploded view of a conventional electrical connector 100*a* to include an insulated body 110*a*, a plurality of terminals 120*a* and two support members 130*a*. The support members 130*a* extend respectively into two lateral sides of the insulated body 110*a*. The insulated body 110*a* is made from dielectric materials and is formed with a plurality of retention holes 111*a*. Each terminal 120*a* has a contact section 121*a*, a securing section 122*a*, an extension section 123*a* and a mounting section 124*a*.

During the production, the insulated body 110*a* is firstly fabricated. Later, the contact and securing section 121*a*, 122*a* of the terminals 120*a* are inserted manually through the respective retention hole 111*a* in the insulated body 110 one after the other, thereby exposing the extension sections 123*a* to an exterior of the insulated body 110*a*. In case, a single terminal 120*a* fails to extend precisely through the retention hole 111*a* in the insulated body 120*a* (i.e bending relative to an adjacent terminal), a disqualified product will be resulted and the disqualified product must be discarded eventually. It is relatively difficult even for a skilled assembler to insert all terminals precisely through the retention holes 111*a* in the insulated body 120*a*.

After assembly, the extension sections 123*a* of the terminals 120*a* are exposed to an exterior of the insulated body 110*a* such that the electromagnetic wave interference (EMI) exists among the extension sections 123*a*. The presence of EMI may affect the signal transmission of the conventional electrical connector 100*a*. In addition, during transportation or shifting of the conventional electrical connector 100*a* from one place to another, the being exposed from the bottom side of the insulated body 100*a* may collide against or entangle with a nearby object, thereby resulting in pulling the terminals 120*a* out from the insulated body 110*a* and causing damage of the conventional electrical connector 100*a*. Moreover, long time exposure of the extension sections 123*a* of the terminals 120*a* to an exterior of the insulated body 110*a* may cause oxidation thereto, which, in turn, decreases the aesthetic appearance of the conventional electrical connector 100, hence the disqualified product. It is difficult to sell out such ugly disqualified product, which must be discarded eventually.

In addition, the contact section 121*a*, the securing section 122*a*, the extension sections 123*a* in each terminal 120*a* are in bifurcation structure such that a lot of waste will be resulted since the terminals 120*a* are fabricated by punching and cutting an elongated metal plate along a longitudinal length thereof, which provides the maximum numbers of terminals in the longitudinal length. The waste resulting therefrom incurs extra manufacturing expense to the producers.

SUMMARY OF THE INVENTION

Therefore, the object of the present invention is to provide an electrical connector produced by injection molding process and including a plurality of terminals partially embedded within a fixing member via an insert-molding process such that the terminals cannot be easily pulled out. In addition, the problem of oxidation at the exposed sections of the terminals as encountered in the prior art electrical connector can be avoided and simultaneously causing little waste when fabricating the terminals from a thin and elongated metal plate.

The electrical connector according to the present invention is produced by an injection molding process and includes an insulated body, a fixing member and a row of terminals.

The insulated body has an insert face formed with a plurality of terminal holes and a mounting face. The insert face is dented inwardly so as to form a plug reception chamber in spatial communication with the terminal holes. The fixing member is integrally formed with the mounting face of the insulated body 210 via an injection molding process.

Each terminal has an embed section embedded within the fixing member along an extension direction via an insert-molding process and a contact section projecting from one end of the embed section through a respective one of the terminal holes and so as to be retained within the plug reception chamber in the insulated body.

Therefore, the embed sections of the terminals are embedded in the fixing member via the insert-molding process while the contact sections thereof extend through the terminal holes in the insulated body and are retained within the plug reception chamber. Therefore, no auxiliary fixing structure of the prior art is required in the present invention. The terminals of the present invention can be fabricated from a thin and elongated metal plate by punching and bending operation without causing a relatively large waste. In addition, since the embed sections of the terminals are embedded securely within the fixing member, the terminals are prevented from being pulled out easily relative to the electrical connector of the present invention. Since only minor portions of the terminals are exposed to the exterior of the insulated body, the occurrence of oxidation problem and electromagnetic interference among the exposed section as encountered during use of the conventional electrical connector can be avoided.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 2:
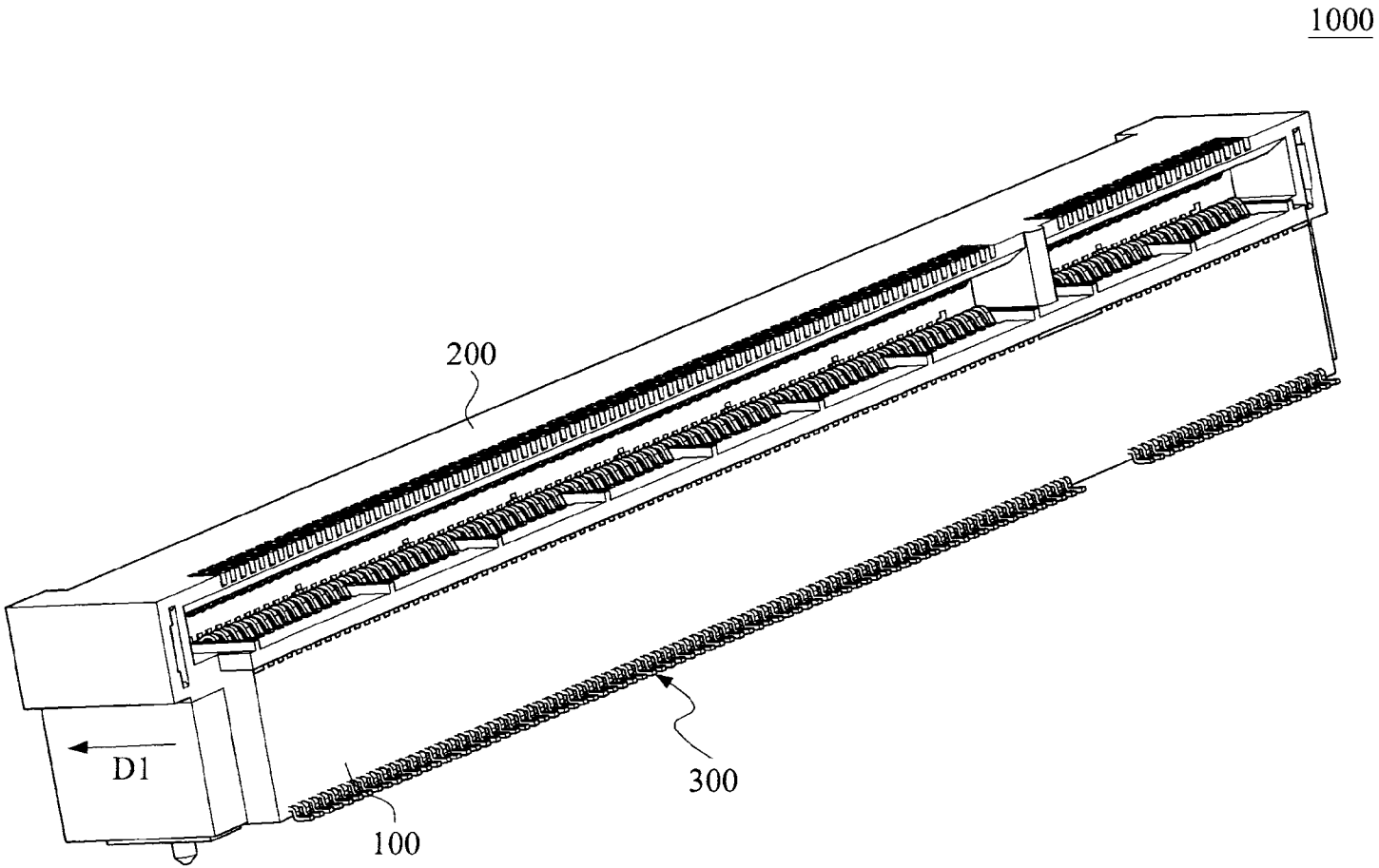
FIG. 2 is a perspective view of an electrical connector of the present invention produced by an injection molding process.

FIG. 2 is a perspective view of an electrical connector 1000 of the present invention produced by an injection molding process. The electrical connector 1000 includes a first coupling structure 100, a second coupling structure 200, a plurality of terminals 300 and a pair of support members (not shown in the drawings).

Figure 1:
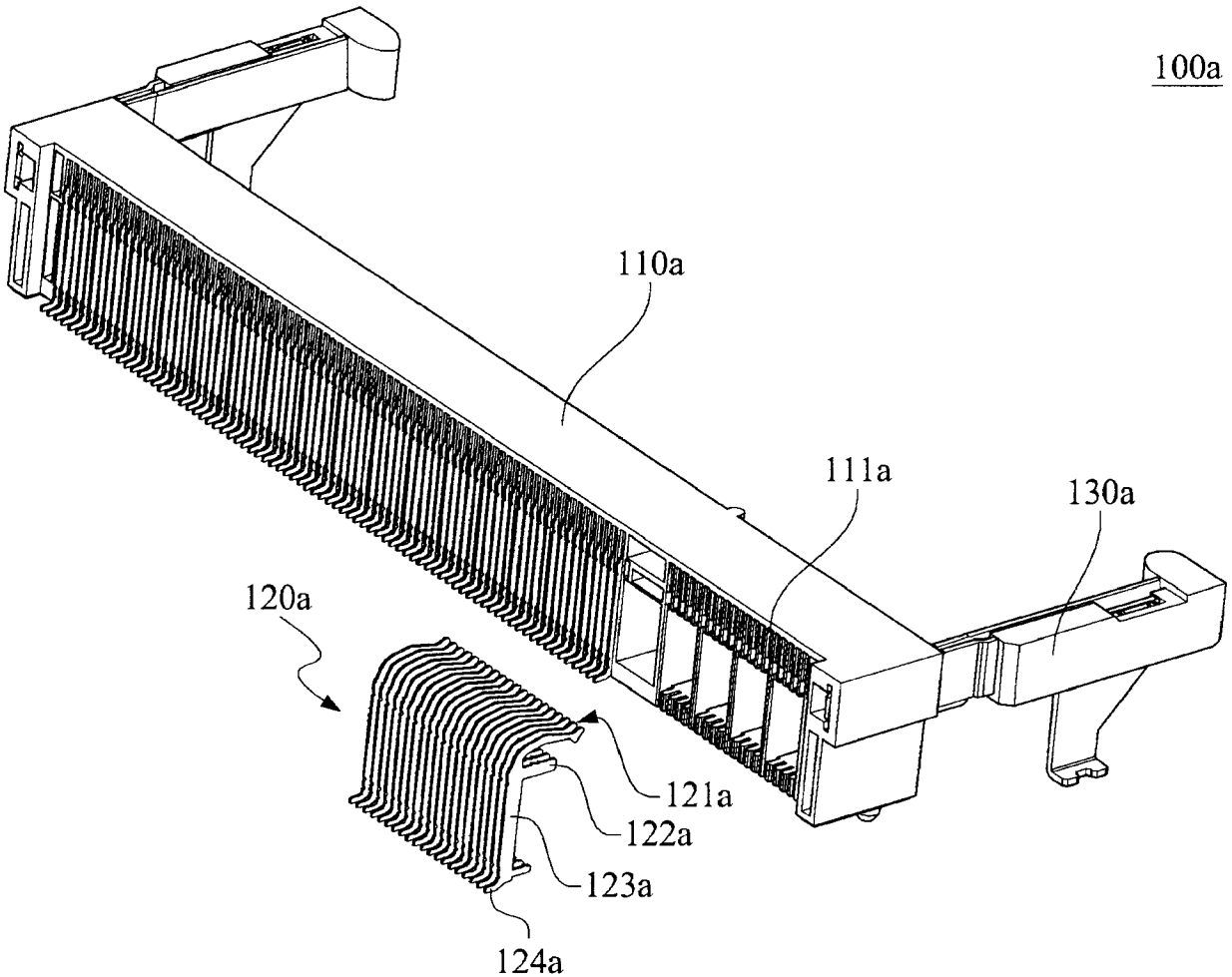
FIG.1(Prior Art)
FIG. 1 is a partly exploded and perspective view of a conventional electrical connector.

The second coupling structure 200 is coupled with the first coupling structure 100 via the injection molding process. Each of the terminals 300 is partially embedded within the first coupling structure 100 via an insert-molding process. The support members 130*a* (see FIG. 1) are inserted respectively along a coupling direction D1 (see FIG. 2) into two lateral sides of the second coupling structure 200.

Figure 3:
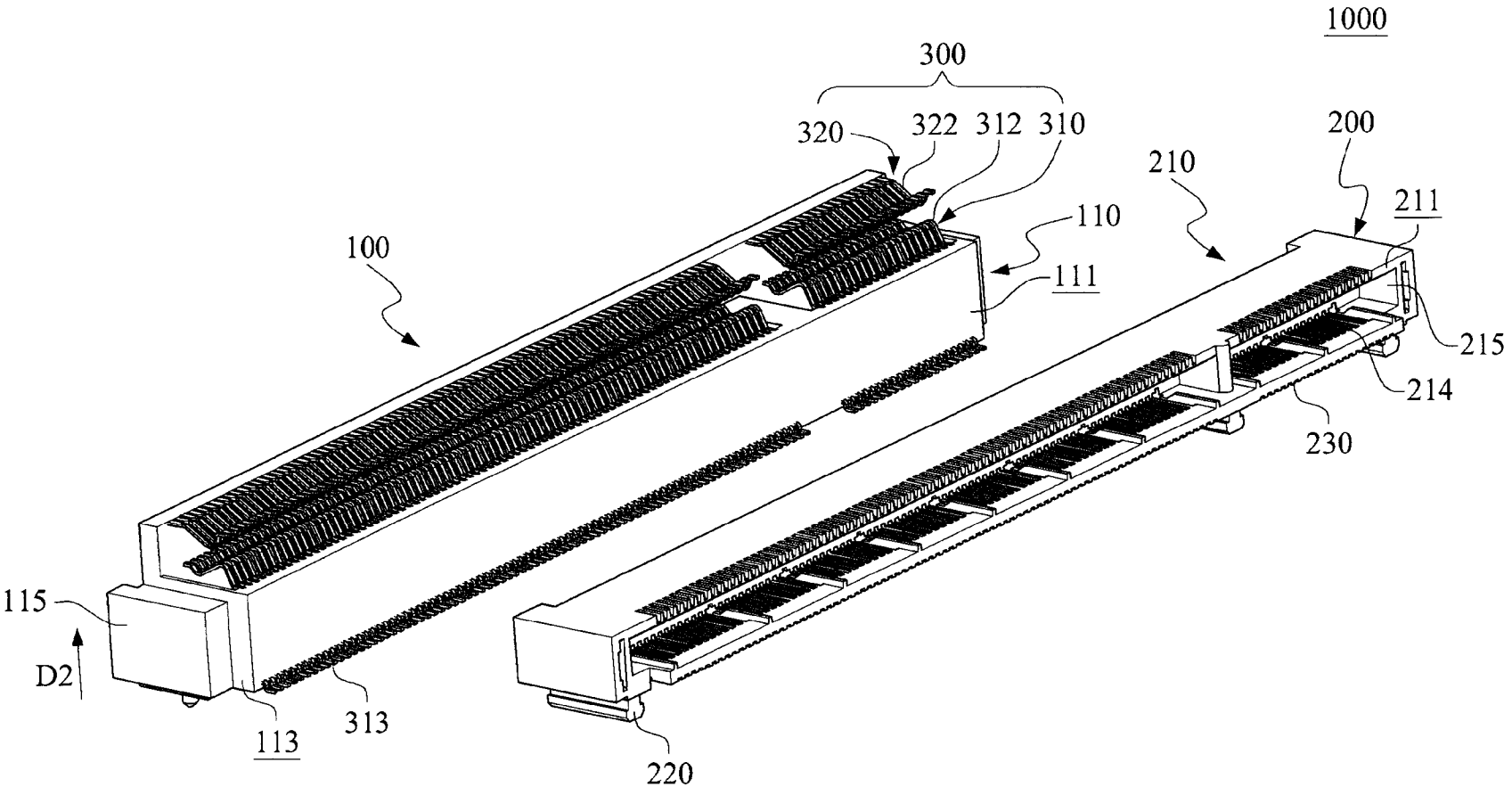
FIG. 3 is an exploded and perspective view of the electrical connector of the present invention.
Figure 4:
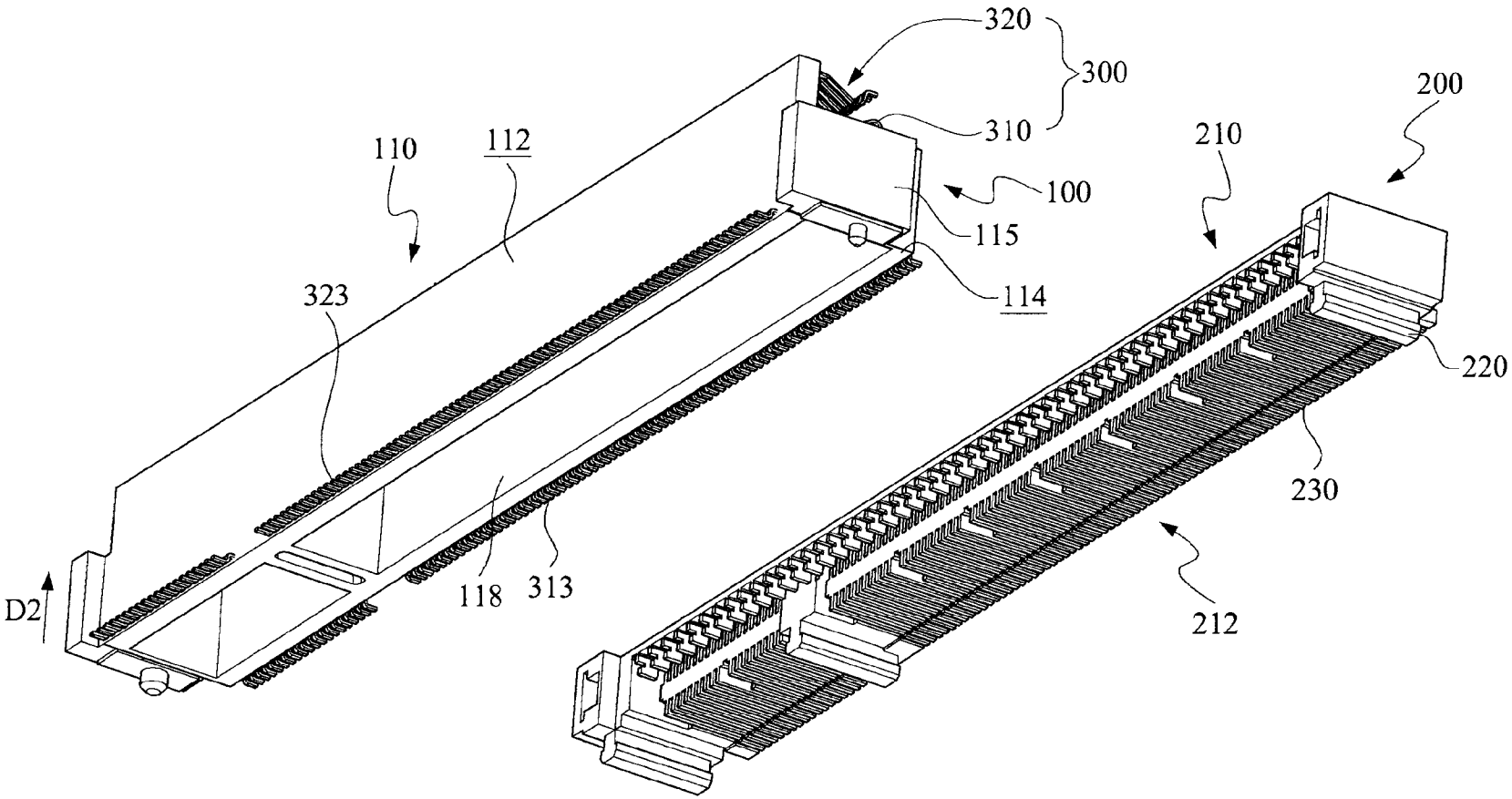
FIG. 4 is an exploded and perspective view of the electrical connector of the present invention from another angle.

Referring to FIGS. 3 and 4, wherein FIG. 3 is an exploded and perspective view of the electrical connector 1000 of the present invention while FIG. 4 is an exploded and perspective view of the electrical connector 1000 of the present invention from another angle. The first coupling structure 100 includes a fixing member 110 and two heat-melt blocks 115 formed at two opposite sides thereof.

The fixing member 110, generally rectangular, has a front end side 111, a rear end side 112 opposite to the front end side 111, two lateral sides 113 interconnecting the front and rear end sides 111, 112, and a bottom side 114 interconnecting the front and rear end sides 111, 112. The fixing member 110 is coupled to the second coupling structure 200 along an extension direction D2. The bottom side 114 of the fixing member 110 is to be mounted on a printed circuit board (not shown) or a mounting assembly.

The bottom side 114 of the fixing member 110 is dented inwardly along the extension direction D2 to form big and small extension holes 118 located between the front and rear end sides 111, 112. By forming the extension holes 118 at the bottom side 114 of the fixing member 110, a relative amount of the material can be economized during the production thereof.

The bottom side 114 of the fixing member 110 is further provided with an extra heat-melt blocks at an intermediate section thereof, the purpose of which will be described later.

The second coupling structure 200 includes an insulated body 210 having a front insert face 211 formed with a plurality of terminal holes 214, a rear insert face and a mounting face 212 (see FIG. 4). The insert face 211 is dented inwardly so as to form a plug reception chamber 215 that is in spatial communication with the terminal holes 214 and that receives a plug of an external electrical connector (not shown). In this embodiment, the bottom side of the insulated body 210 serves as the mounting face 212 and permits extension of the terminal holes 214 therethrough. Alternately, the terminal holes 214 can extend through the rear insert face of the insulated body 210.

Two fixing elements 220 extend outwardly and downwardly from the insulated body 21. When the fixing member 110 is coupled to the mounting face 212 of the insulated body 210 via the injection molding process, the fixing elements 220 will be embedded integrally within the heat-melt blocks 115 of the fixing member 110. The fixing element 220 can be any fastening structure for securely coupling the fixing member 110 and the insulated body 210.

The mounting face 212 of the insulated body 210 can be formed with a plurality of position retention channels 230 which are filled by the fixing member 110 during the injection molding process. Thus, after assembly, the fixing member 110 and the insulated block 210 are prevented from lateral movement relative to each other.

Figure 5:
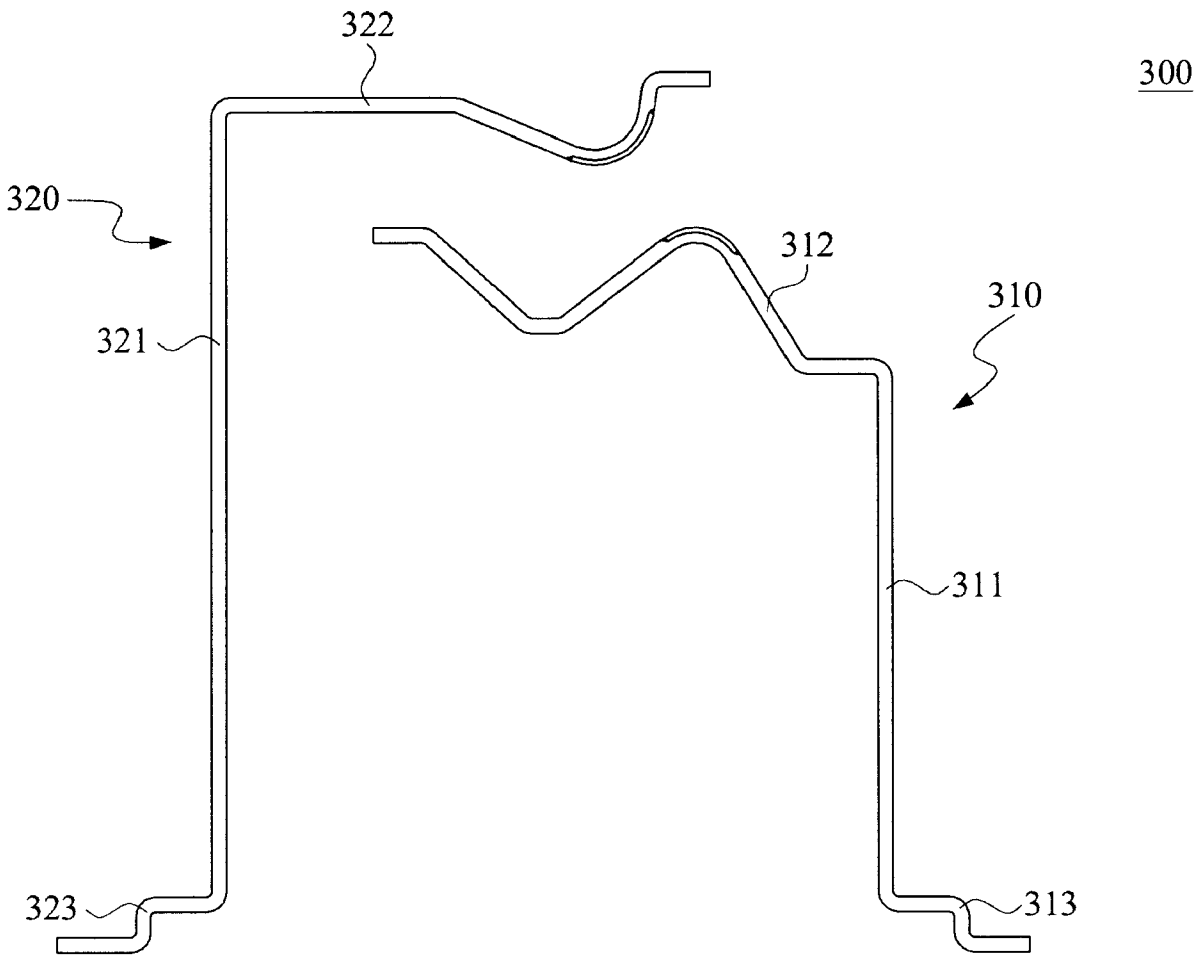
FIG. 5 shows two terminals employed in the electrical connector of the present invention.
Figure 5A:
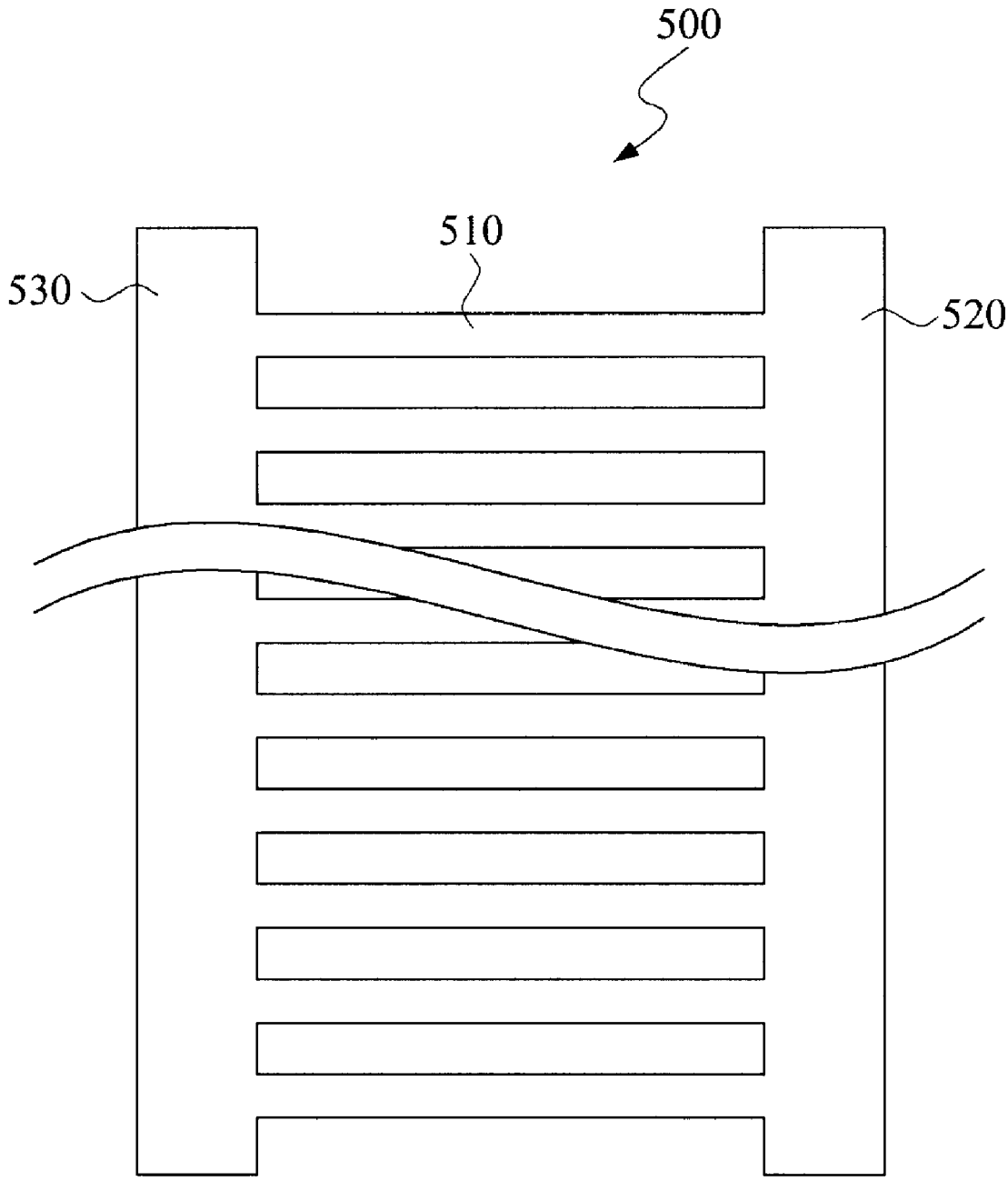
FIG. 5A illustrates a thin and elongated metal plate for forming the terminals employed in the electrical connector of the present invention.

The terminals 300 includes a front row of terminals 310 and a rear row of terminals 320. FIG. 5 shows two terminals representing front and rear rows of terminals 310, 320 employed in the electrical connector of the present invention. Each of the front terminals 310 has a front embed section 311, a front contact section 312 and a front mounting section 313. Each of the rear terminals 320 has a rear embed section 321, a rear contact section 322 and a rear mounting section 323. FIG. 5A illustrates a thin and elongated metal plate 500, which is punched and bent for forming the terminals employed in the electrical connector of the present invention. As illustrated, the metal plate 500 includes a plurality of half-finished terminals 510 integrally formed with the first and second distal ends 520,530. After undergoing the punching and bending process, the distal ends 520, 530 are cut off without causing a large amount of metal waste when compared to the prior art manufacturing technology. Then, the half-finished terminals 510 become the front and rear terminals 310, 320 as shown in FIG. 5. Afterward, the front or rear row of terminals 310, 320 are inserted in lot through the terminal holes 214 in the insulated body 210 (see FIG. 6) in such a manner to provide uniform alignment among the terminals 310, 320, thereby shortening the assembly time and enhancing the quality of the electrical connector of the present invention.

In fact, the front embed sections 311 of the front terminals 310 are embedded within the front end side 111 of the fixing member 110 along an extension direction D2 via the insert-molding process. The front contact sections 312 project from the first ends of the front embed sections 311 through the terminal holes 214, and are retained within the plug reception chamber 215 in the insulated body 210. The front mounting sections 313 extend from the second ends of the front embed section 310, and are exposed to an exterior from the front end side 111 of the fixing member 110.

In the same manner, the rear embed sections 321 of the rear terminals 310 are embedded within the rear end side 112 of the fixing member 110 along the extension direction D2 via the insert-molding process. The rear contact sections 322 project from the first ends of the rear embed sections 321 through the terminal holes 214, and are retained within the plug reception chamber 215 in the insulated body 210. The rear mounting sections 323 extend from the second ends of the rear embed sections 320, and are exposed to an exterior from the rear end side 112 of the fixing member 110. In other words, the front and rear contact sections 312, 322 of the terminals 310, 320 terminals are retained within the plug reception chamber 215 of the insulated body 210 so as to make electrical connection with the inserted plug (not shown).

Figure 6:
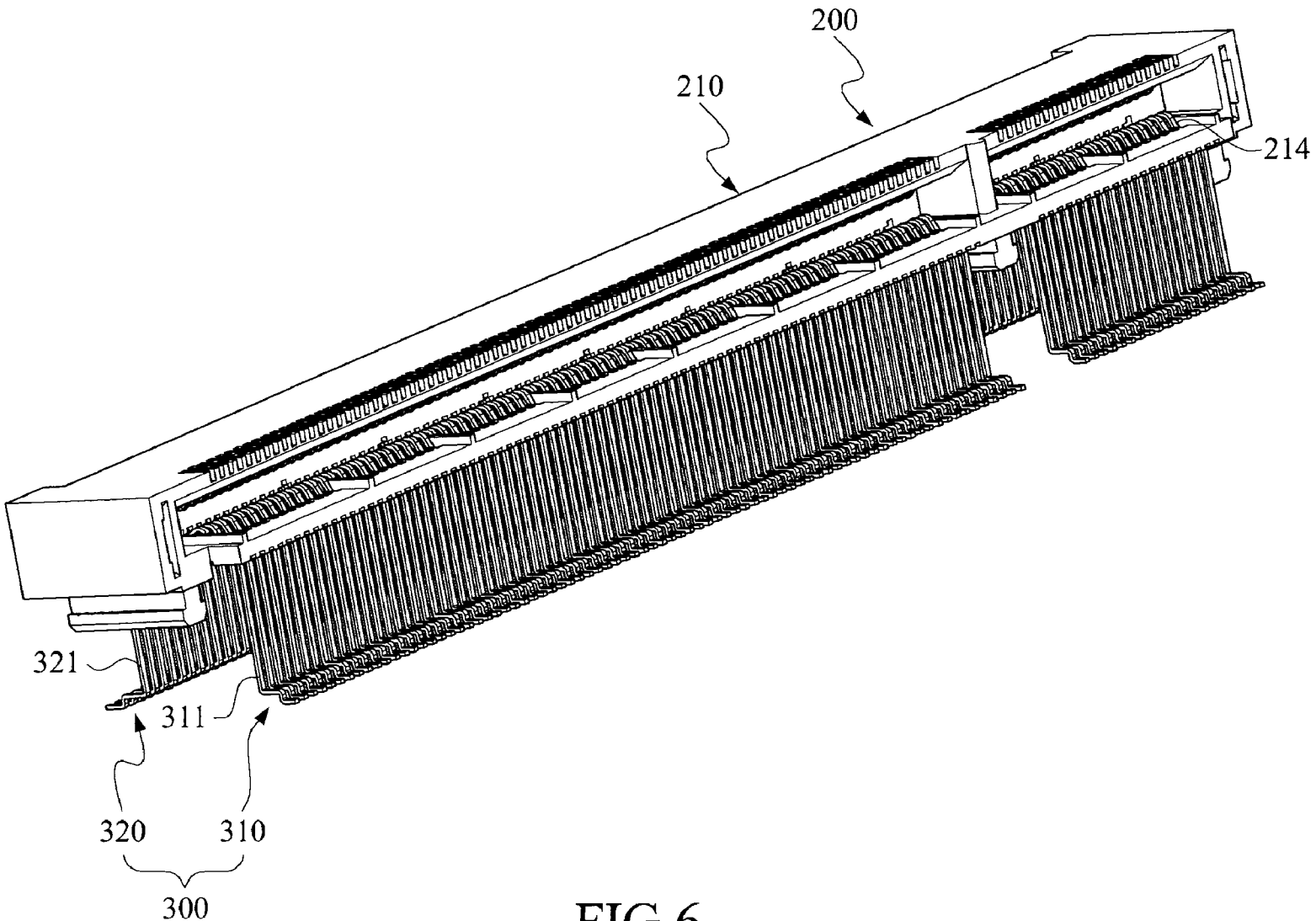
FIG. 6 illustrates how the terminals are mounted to an insulated body prior to undergoing the insert-molding process according to the present invention.

Referring to FIG. 6, during production of the electrical connector 1000 of the present invention, the second coupling structure 200 is disposed first of all into a mold (not shown), where, the front and rear terminals 310, 320 are inserted in lot through the terminal holes 214 in the insulated body 210. Afterward, the first coupling structure 100 is attached to the mounting side 212 of the second structure 200 via the injection molding process such that the front and rear embed sections 311, 321 are embedded within the fixing member 110 via the insert-molding process so that the terminals 300 becomes an integral part and are fixed securely in the fixing member 110. Thus, the first and second coupling structures 100, 200 are integrally formed with each other and result in the electrical connector 1000 as shown in FIG. 2.

Figure 7:
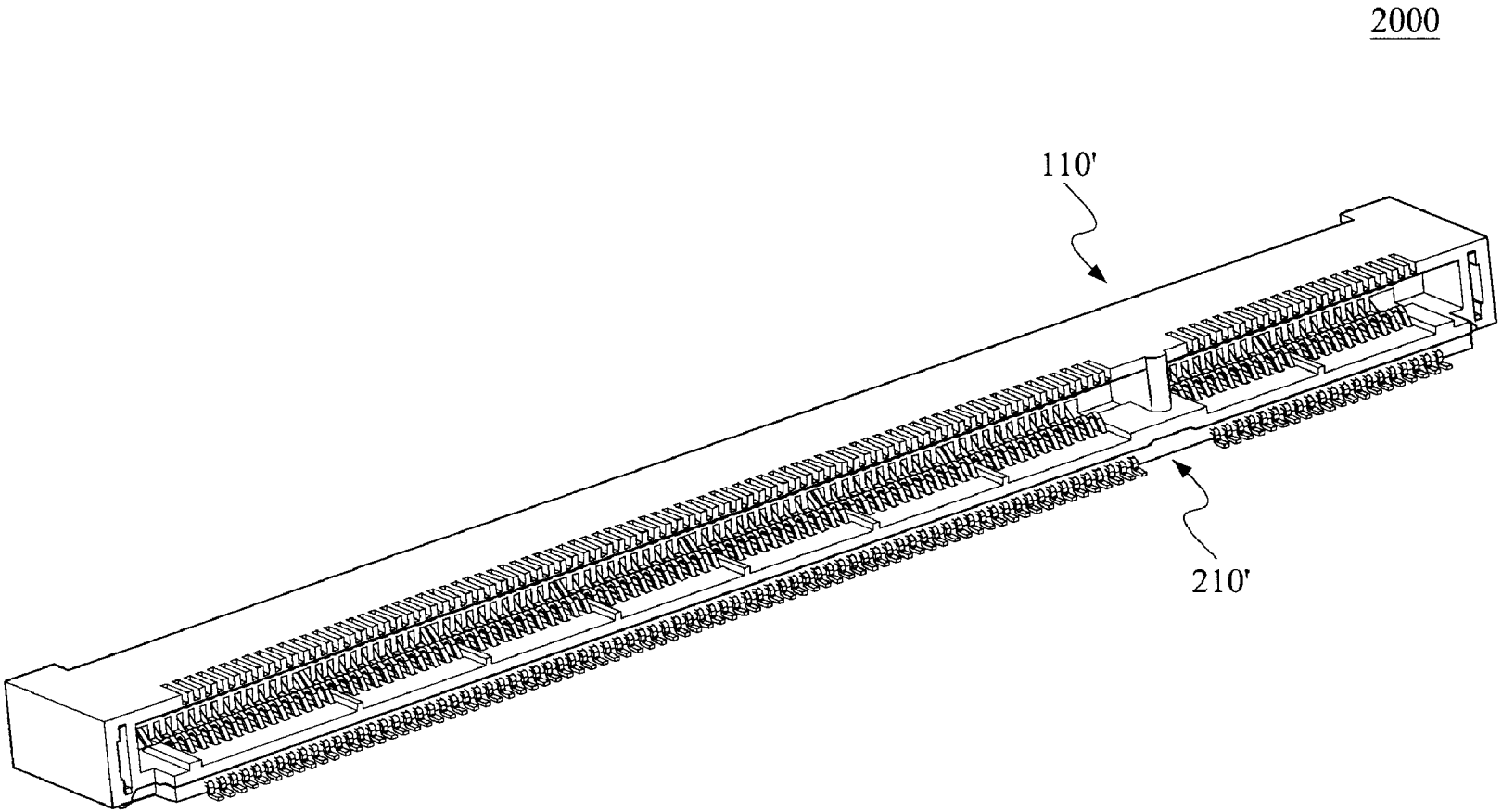
FIG. 7 shows a perspective view of a modified embodiment of the electrical connector of the present invention produced by the injection molding process.
Figure 8:
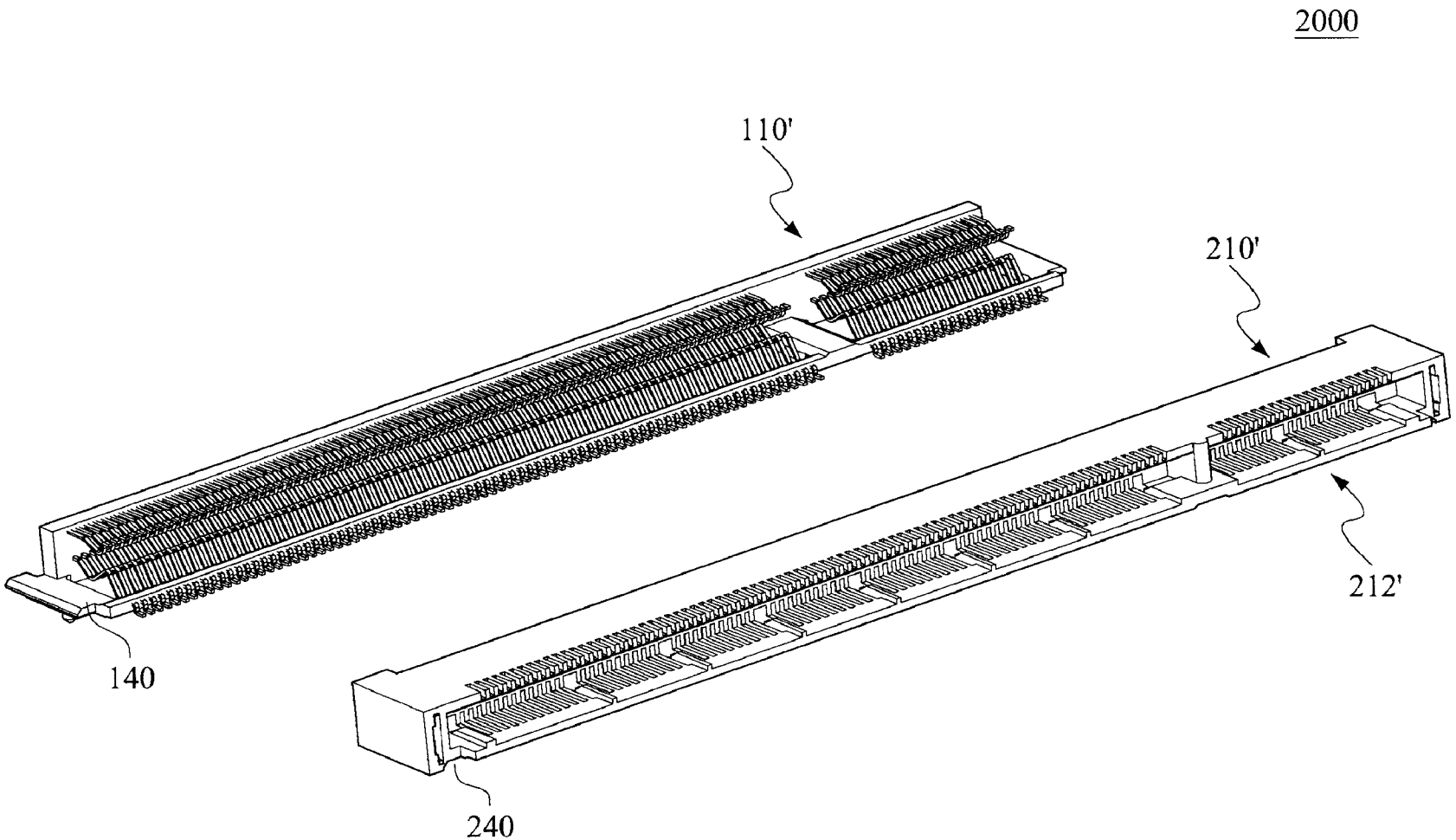
FIG. 8 is an exploded and perspective view of the modified embodiment of the electrical connector of the present invention.

FIG. 7 shows a perspective view of a modified embodiment of the electrical connector 2000 of the present invention produced by the injection molding process while FIG. 8 is an exploded and perspective view of the modified embodiment of the electrical connector 2000 of the present invention. The only difference resides in that the fixing member 110' has a smaller height in compare to the previous embodiment so that no heat-melt block and fixing elements are provided in the modified embodiment. The fixing member 110' has a first limit element 140 while the insulated body 210' has a second limit element 240 at the mounting side 212' thereof. The first and second limit elements 140, 240 can be projection and recess structure for enhancing coupling of the fixing member 110' and the insulated body 210' during the injection molding process. As explained above, the front embed sections 311 of the front terminals 310 are embedded within the fixing member 110 via the insert-molding process such that the front contact sections 312 thereof extend through the terminal holes 214 and are retained within the plug reception chamber 215. No auxiliary fixing device is required to maintain the position of the front terminals 310. The terminals of the present invention can be fabricated from an elongated metal plate by punching and bending operation without causing a relatively large waste. In addition, since the front and rear embed sections of the terminals are embedded securely within the fixing members; the terminals are prevented from being pulled out easily from the electrical connector of the present invention. Since only minor portions of the terminals are exposed to the exterior of the insulated body, the occurrence of oxidation problem and electromagnetic interference among the exposed section as encountered during use of the conventional electrical connector can be avoided.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electrical connector comprising:

an insulated body having an insert face formed with a plurality of terminal holes and a mounting face, said insert face being dented inwardly so as to form a plug reception chamber in open communication with said terminal holes;

at least one fixing element extending outwardly and downwardly from said insulated body;

a plurality of terminals including a front row of terminals and a rear row of terminals, each of said plurality of terminal having an embed section and a contact section extending from one end of said embed section; and a fixing member having a top side and affixedly capturing said plurality of terminals arranged in an extension direction by an insert molding process, said embed section of each of said plurality of terminals being embedded therein, said fixing member being joined to said mounting face of said insulated body by a molding process with said contact section of each of said plurality of terminals respectively passing through a corresponding one of said terminal holes to be disposed within said plug reception chamber in said insulated body, said at least one fixing element being embedded in said mounting face by said molding process to integrally join to said top side of said fixing member to said insulated body in one-piece formation.

2. The electrical connector according to claim 1, wherein said fixing member has a front end side and a rear end side opposite to said front end side, said embed sections of said front terminals being embedded within said front end side via the insert-molding process and extending therefrom toward said rear end side.

3. The electrical connector according to claim 2, wherein each of said front terminals further has a front mounting section projecting from another end of said embed section thereof and being exposed at an exterior of said front end side of said fixing member.

4. The electrical connector according to claim 2, wherein each of said rear terminals further includes a rear mounting section projecting from another end of said embed section thereof and being exposed at an exterior of said rear end side of said fixing member.

5. The electrical connector according to claim 2, wherein said fixing member further has a bottom side interconnecting the front and rear end sides, said bottom side being dented inwardly to form an extension hole therein.

6. The electrical connector according to claim 1, wherein said mounting face of said insulated body is formed with a plurality of position retention channels for integrally being joined with said fixing member by the molding process.

* * * * *